United States Patent [19]

Holwager

[11] 4,087,771

[45] May 2, 1978

[54] ELECTRICAL SWITCH

[76] Inventor: George H. Holwager, 502 Sable Palm Dr., Lake Park, Fla. 33403

[21] Appl. No.: 735,898

[22] Filed: Oct. 26, 1976

[51] Int. Cl.[2] ..... H01H 3/00

[52] U.S. Cl. ..... 335/190; 335/189

[58] Field of Search ..... 335/190, 73, 189, 191, 335/131

[56] References Cited

U.S. PATENT DOCUMENTS

| | | | |
|---|---|---|---|
| 2,874,244 | 2/1959 | Hamblett et al. | 335/190 |
| 3,482,192 | 12/1969 | Walker | 335/190 |
| 3,641,466 | 2/1972 | Ernst | 335/190 |
| 3,766,501 | 10/1973 | Hotte et al. | 335/190 |

*Primary Examiner*—Harold Broome

*Attorney, Agent, or Firm*—Woodard, Weikart, Emhardt & Naughton

[57] ABSTRACT

An electrical switch is disclosed herein which comprises a member rotatably mounted upon a support and having contact arms connected thereto. The member has a first position in which the contact arms touch contacts mounted to the support, and a second position rotated from the first position in which the contact arms are spaced apart from the contacts. A T-bar is slidably mounted upon the support and is operable to move the member between the first and second positions. The T-bar includes a cross member which has lipped ends positioned and sized to engage certain surfaces of the member. A solenoid and a spring are associated with the T-bar and are operable to move the T-bar in first and second, opposed directions, respectively. As the T-bar moves in the second direction, one end of the cross member engages a surface of the rotatable member and moves the member from one position to the other. In a particular embodiment of the present invention, the solenoid is connected to the low voltage side of a transformer which is connected at its high voltage side to an electrical power source. a pushbutton or other switch is connected between the solenoid and the transformer to permit momentary activation of the solenoid to change the position of the rotatable member.

13 Claims, 6 Drawing Figures

ELECTRICAL SWITCH

BACKGROUND OF THE INVENTION

1. Field of the Invention

The present invention relates to electrical switches, and more particularly to a switch which may be remotely controlled through low voltage wiring to turn a particular electrical appliance on or off.

2. Description of the Prior Art

The use of remotely controllable switches is known in the art. These type of switches typically include a solenoid which performs the mechanical operations required to switch the particular appliance or outlet on or off. The complexity and related expense of prior art switches of this type have made it desirable for a switch of a more simple and economical design to be devised.

Solenoid-containing switches are of two general types. In the first type, the solenoid state directly corresponds to the state of the connected electrical appliance. In other words, the solenoid is in the activated or non-activated condition for the entire time that the appliance is in the associated on or off state. The problem with this type of switch is that the solenoid may be required to be activated for a long period of time, and the useful life of the switch is therefore limited. A second type of solenoid-containing switch includes a solenoid which is only momentarily activated to change the state of the connected electrical appliance. A typical switch of this type includes a ratchet wheel assembly in which the ratchet wheel is moved in progressive steps with successive activations of the solenoid. Each successive movement of the ratchet wheel corresponds with a change in the state of the connected electrical appliance. It is desirable, however, to provide a switch which does not entail the complex and relatively expensive components which make up the ratchet-type solenoid switch.

More generally, a variety of types of switches have been proposed in the prior art for providing remote control of, for example, a particular electrical appliance or outlet. It is particularly desirable that such a remote system be inexpensive and simple in function and construction. It is also desirable that the components of the switch have a relatively long useful life so that the switch will not need to be repaired or replaced with undue frequency. Further, the switch should entail a minimum of operating cost in terms of the amount of electrical power required. In this regard, the switch is most preferably operated with a low voltage circuit which will not create a significant drain on the power source.

SUMMARY OF THE INVENTION

The electrical switch of the present invention comprises a support, a member rotatably mounted upon said support, contacts mounted to said support and connectable to an electrical circuit, contact arms electrically connected together and attached to said rotatable member, said member having a first position in which said arms are spaced apart from said contacts and second position in which said member has been rotated from the first position and in which said arms touch said contacts, and rotating means for successively rotating said member between the first and second positions. More particularly, the present invention includes a T-bar having a base and a cross member and being mounted upon said support to slide along its base, the cross member having first and second ends and the rotatable member having first and second surfaces positioned to be engaged by the first and second ends, and sliding means for moving said T-bar in said first and second directions along its base, successive sliding of the T-bar in the first and second directions causing the first and second ends of the cross member to alternately engage the respective surface of said rotatable member to move said member between the first and second positions.

It is an object of the present invention to provide an electrical switch which permits an electrical appliance or the like to be controlled from any position remote from the appliance.

Another object of the present invention is to provide an electrical switch which permits remote control of an electrical circuit and which operates on a low voltage system.

A further object of the present invention is to provide an electrical switch of the described type which is easily and inexpensively manufactured, and which will have a long useful life.

It is another object of the present invention to provide an electrical switch as described which may be either mechanically operated at the switch, or electrically operated at a position remote from the switch.

Further objects and advantages of the present invention will become apparent from the figures and description which follow.

DESCRIPTION OF THE PREFERRED EMBODIMENT

Figure 1:
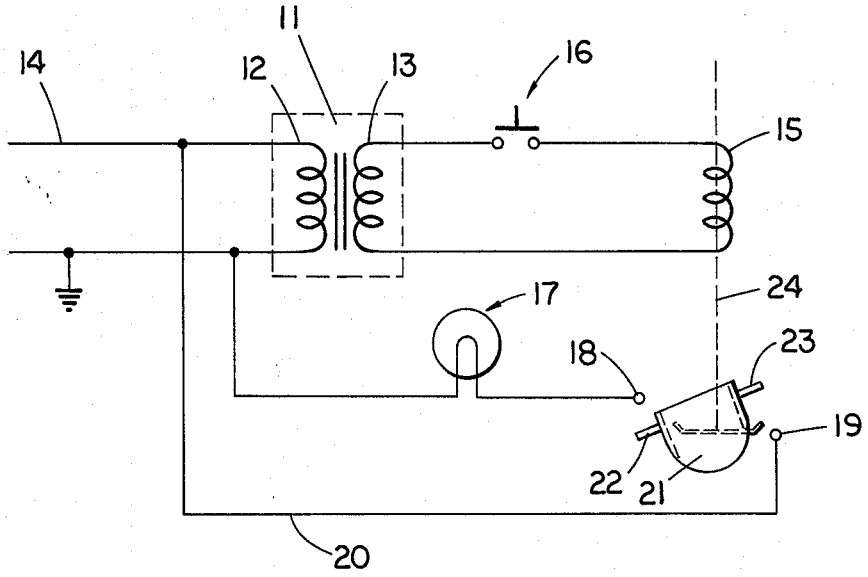
FIG. 1 is a schematic circuit diagram of the electrical switch of the present invention and its connection to an electrical system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a schematic circuit diagram of an electrical system utilizing a switch in accordance with the present invention. The system includes a standard transformer 11 having a primary winding 12 and a secondary winding 13. One end of the primary winding 12 is connected through lead 14 to an AC supply source and the other end is connected to ground. Solenoid 15 is connected across secondary winding 13 through pushbutton switch 16. Light 17 is connected between contact 18 and ground, and contact 19 is connected through lead 20 to the AC power source.

Rotatable member 21 supports contact arms 22 and 23, the contact arms being electrically connected together. T-bar 24, responsive to the action of solenoid 15, is operable to rotate member 21 successively between a first, open position, as shown, and a second, closed position (FIG. 6) in which contact arms 22 and 23 contact the contacts 18 and 19, respectively. Thus, in the closed position of member 21, the connection of light 17 from the AC power source to ground is completed.

Figure 2:
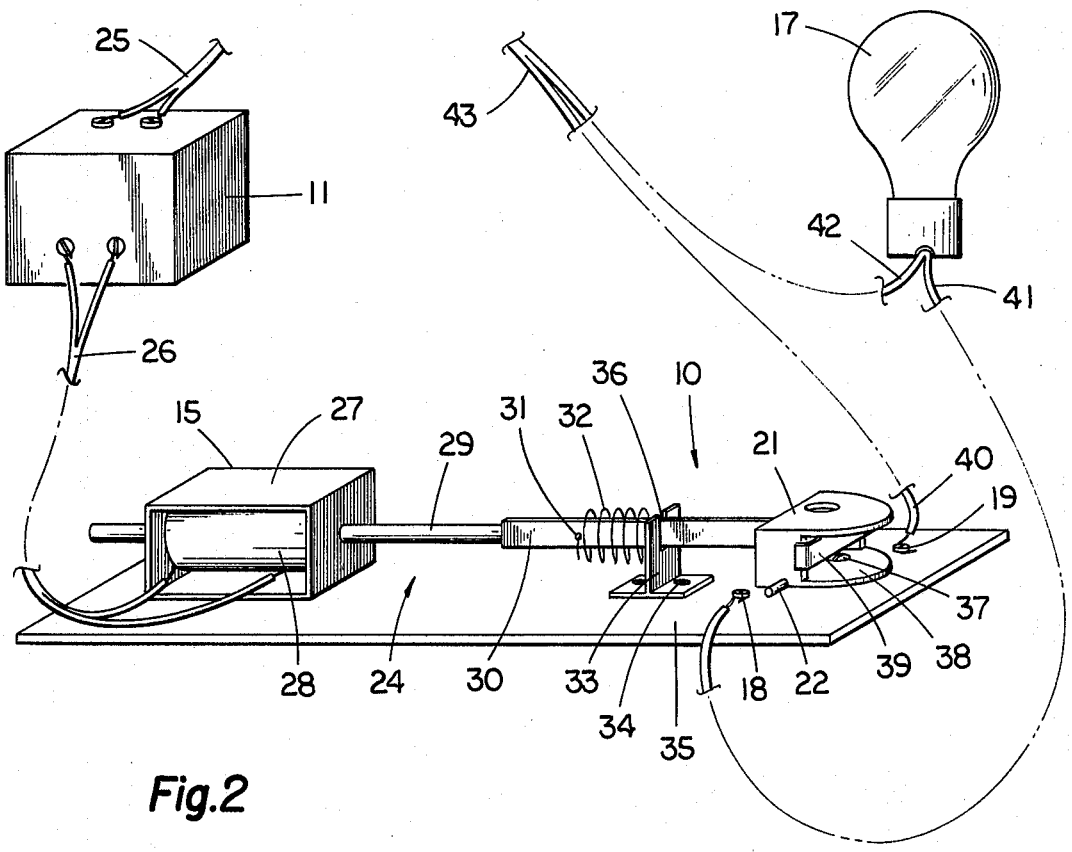
FIG. 2 is a perspective view of an embodiment of the electrical switch of the present invention shown connected to a circuit including a leg bolt.

Referring now to FIG. 2, there is shown the preferred arrangement of the physical components of a system utilizing switch 10 in accordance with the present invention. The primary winding of transformer 11 is connected through wires 25 to the AC power source. The secondary winding is connected to solenoid 15 through wires 26. Solenoid 15 includes a casing 27 which is suitably secured to support 35, such as by screws threadedly received within support 35. Solenoid 15 includes a magnetic coil 28 mounted within the insulative casing 27 and defining in the conventional manner a hollow core within which armature or plunger 29 is received.

Armature 29 forms a first portion of the base of T-bar 24, which further includes a flexible member 30 secured, as by soldering, to armature 29. Member 30 is preferably an elongated, flat band of a plastic or metal which will not permanently deform when bent to the extent required by switch 10. Support 33 is suitably secured to support 35, as by screws 34. Member 30 is received within and supported by opening or notch 36 formed in the upright arm or portion of support 33. A coil spring 32 is positioned about member 30 and has a first end secured to member 30, such as by reception within aperture 31. The other end of spring 32 rests adjacent and engages the upright portion of support 33. The cross member 39 of T-bar 24 is connected to flexible member 30, and to insure consistent operation and long life of the switch is preferably formed integral with flexible member 30. This may be accomplish in several known ways, such as by molding member 30 and cross member 39 from plastic as a single unit.

Rotatable member 21 is pivotally connected to platform 35. Pivot pin 37 extends through an aperture in the bottom 38 of member 21, pin 37 being secured to support 35 and bottom 38. Member 39 is therefore free to rotate about pin 37. Pivot pin 37 and the base of T-bar 24 are aligned such that the rotational axis of member 21 lies in a plane which extends normal to support 35 through the longitudinal axis of armature 29 and member 30. Other conventional techniques for pivotal attachment of member 21 to support 35 would also be acceptable. As will be more fully described below, the pivotal attachment of member 21 to support 35 permits T-bar 24, through the activation of solenoid 15, to move contact arms 22 and 23 into and out of engagement with contacts 18 and 19.

The switch assembly is connected to the light, electrical outlet, or other electrical component which is desired to be remotely controlled. Contact 19 is connected through wires 40 and 43, which may of course be portions of a continuous length of wire, to a suitable AC power source. Contact 18 is connected through wire 41 to the particular electrical component, which in FIG. 2 is shown to be light 17, which is in turn connected through wires 42 and 43 to an AC power source. It will be seen from FIG. 2 that switch 10 may be readily added to an existing electrical system. Thus, light 17 would ordinarily be connected to wires 43 by a first wire 42, and a second wire which would be the equivalent of a direct connection between wires 40 and 41. In the conventional manner of connecting components in series, the switch 10 would be attached by cutting the wire which is the equivalent of a connection between wires 40 and 41 and thereafter connecting one end to contact 19 and the other end to contact 18. By this connection, the circuit from the AC power source through light 17, or a similar electrical component, is completed by the electrical connection between contacts 18 and 19. This is accomplished by the switch 10 in accordance with the present invention, as will now be more fully described.

Figure 3:
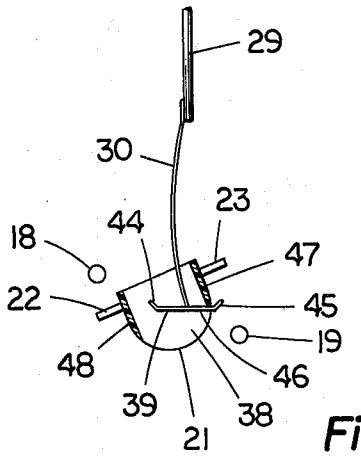
FIG. 3 is a top, plan view of the T-bar and rotatable member of the present invention, the rotatable member being shown in a first position and the T-bar being shown moved fully in the second direction.

Referring now to FIGS. 2–6, the operation of switch 10 may be fully appreciated. In FIG. 3 there is shown the T-bar in its normal, longitudinal position with respect to member 21 when solenoid 15 is not activated. Rotatable member 21 is shown in a first of two positions corresponding with the position of the T-bar during the time that solenoid 15 is not activated. Contact arms 22 and 23 mounted upon member 21 are displaced from contacts 18 and 19, thus causing the circuit through light 17 to be open and the light therefore to be off. As shown in FIG. 3, cross member 39 has ends 44 and 45 which include portions angularly disposed from the central body 46 of cross member 39 toward the base of T-bar 24. Ends 44 and 45 thereby form lips which will engage respective surfaces of the walls 48 and 47, respectively, of member 21. In this first position of rotatable member 21, wall 47 is engaged by lip or end 45. The lip 45 engaging wall surface 47 causes flexible member 30 to be pulled in that direction and therefore to bend slightly as shown.

The position of armature 29 and flexible member 30 of the T-bar in the position corresponding to non-activation of solenoid 15 is determined by the action of spring 32 (FIG. 2) between its attachment to flexible member 30 and its engagement of support 33. With solenoid 15 not activated, armature 29 is free to move through the hollow core of coil 28 under the influence of spring 32.

The extent of travel of T-bar 24 may be controlled in several ways. For example, a stop could be included with armature 29 which would engage solenoid casing 27 to prevent movement of armature 29 therethrough beyond a certain extent. Similarly, a stop could be attached to flexible member 30 to engage support 33 at a predetermined point. Preferably, however, stops (not shown) are secured to platform 35 and are positioned between support 33 and member 21 to engage the rear portion of bottom 38 to prevent rotation of member 21 beyond a certain extent. Spring 32 is then selected to normally urge T-bar 24 in the direction of solenoid 15 an extent greater than permitted by the placement of the stops behind rotator 21, thus assuring a full rotation of rotator 21 to the extent permitted by the stops.

Figure 4:
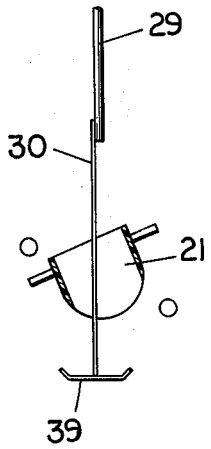
FIG. 4 is a top, plan view of the T-bar and rotatable member of the present invention, the T-bar being shown moved to its furthest extent in the first direction.

In FIG. 4 there is shown the position of the T-bar which corresponds to activation of solenoid 15. As the pushbutton 16 (FIG. 1) or other suitable switch is used to close the connection of secondary winding 13 with coil 28 a magnetic field is developed as is conventionally known in the art relating to the operation of solenoids. Coil 28 is so oriented as to cause movement of T-bar 24 in the direction of support 33 upon activation of the coil. In doing so, cross member 39 is moved to a position beyond rotatable member 21. The resilient material comprising flexible member 30 is thereby permitted to reassume its normal, straight condition as depicted.

Figure 5:
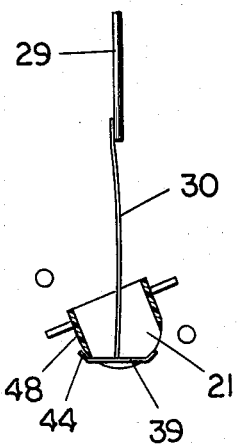
FIG. 5 is a top, plan view of the T-bar and rotatable member of the present invention, the T-bar being shown in the position in which it first engages the second surface of the rotatable member as the T-bar moves in the second direction.

In FIGS. 2 and 5 there is shown the position of T-bar 24 shortly after solenoid 15 has been deactivated. As the magnetic field created by coil 28 dissipates, spring 32 operates to move armature 29 and flexible member 30 in the direction of solenoid 15, thus moving cross member 39 in the direction of rotatable member 21. As this occurs, the wall 48 of rotator 21 engages lip or end 44 of cross member 39. Flexible member 30 is then caused to bend slightly in the direction of wall 48 as lip 44 or end moves along wall 48.

Figure 6:
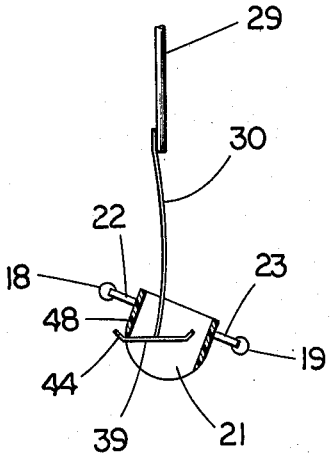
FIG. 6 is a top, plan view of the T-bar and rotatable member of the present invention, the T-bar being shown moved to its fullest extent in the second direction and the rotatable member being shown in a second position.

As spring 32 continues to move T-bar 24 in the direction of solenoid 15, cross member 39 acts upon wall 48 and causes rotatable member 21 to rotate to the second position shown in FIG. 6. Upon rotation, contact arms 22 and 23 are moved into engagement with contacts 18 and 19, respectively, and the contacts are electrically connected. This in turn closes the circuit through light 17 and causes the light to be turned on.

Solenoid 15 may then be subsequently activated to cause T-bar 24 to again slide successively in a first direction displacing cross member 39 from rotatable member 21, and then in a second direction moving cross member 39 against a wall or a surface of member 21. Upon the next activation of solenoid 15 following the condition depicted in FIG. 6, T-bar 24 would initially be moved to the position shown in FIG. 4, the only difference being that rotatable member 21 would remain in the second position shown in FIG. 6 in which the contact arms 22 and 23 are touching the contacts 18 and 19. When the solenoid is deactivated, the magnetic field would again dissipate and spring 32 would move T-bar 24 in the direction of solenoid 15, the result being that the end portion 45 of cross member 39 would engage the surface of wall 47 and rotatable member 21 would again be moved to the first position shown in FIG. 3. Similarly, repeated momentary activation of solenoid 15 would result in the T-bar moving away from the solenoid and then toward the solenoid in the manner described. With activation of solenoid 15, the ends 44 and 45 of cross member 39 would alternately engage the respective wall of rotatable member 21, and member 21 would be moved successively between the first and second positions specifically shown in FIGS. 3 and 6.

As shown in the figures, the surfaces of walls 47 and 48 are positioned to be engaged by the respective ends 44 and 45 of cross member 39 when T-bar 24 is moved in the second direction. T-bar 24 is positioned to have the rotational axis of member 21 to lie in a plane which extends normal to support 35 and passing through the longitudinal axis of the base of T-bar 24. Engagement of the surfaces of walls 47 and 48 occurs due to the fact that the wall surface to be engaged as the T-bar 24 is moved in the second directon is positioned closer to the above-described plane than is the respective end of cross member 39. Thus, in FIG. 5 it is shown that end 44 is located a greater perpendicular distance from the longitudinal axis of the base of T-bar 24 than is the engaging surface of wall 48. This results in the end 44 engaging wall 48 as the T-bar is moved in the second direction, rotatable member 21 thereby being moved to the second, closed position as shown in FIG. 6. Similarly, rotatable member 21 is moved to the first position (FIG. 3) because the successive movement of T-bar 24 in the first and second directions will result in the end 45 of cross member 39 being positioned a greater perpendicular distance from the above-described plane than is the engaging surface of wall 47, the movement of T-bar 24 in the second direction thus causing end 45 to engage wall 47 and moving rotatable member 21 to the first position as shown in FIG. 3. In this manner, a method for controlling the activation of an electrical system may be described as comprising the steps of moving T-bar 24 in a first direction to displace cross member 39 from rotatable member 21, thereafter moving T-bar 24 in the second, opposite direction to cause one end of cross member 39 to engage a respective surface of rotatable member 21, and thereafter moving the T-bar again in the first and then the second directions to cause the other end of cross member 39 to engage a respective surface rotatable member 21 to move the rotatable member to the other position.

An additional feature of switch 10 of the present invention is apparent in FIG. 2. Due to the particular combination of elements, the end of armature 29 opposite cross member 39 includes a portion which may be exposed for manual manipulation of the switch. Thus, the switch 10 could be installed at a position which is at or near the particular electrical component desired to be controlled. The activation of the solenoid switch at that location could be accomplished either by a mechanical movement of armature 29, or by electrical movement of armature 29 through activation of solenoid 15. Switch 10 could further be controlled at a position remote from the electrical component being controlled by connection of a pushbutton such as 16, which would be connected in series along wires 26 and placed at a remote location. A particular advantage of the switch of the present invention is that the pushbutton 16 is connected in a low voltage system which would therefore not require that the wires meet the higher demands and usual building code restrictions which pertain to the higher voltage wiring. Thus, relatively inexpensive wire could be used to provide the remote switching capability of the switch of the present invention, and the cost inherent in 3-way wiring and other remote switching devices would be avoided. Further, any number of these remotely located pushbuttons or similar devices could be arranged in parallel to provide remote control of switch 10 at a variety of locations.

The electrical switch 10 of the present invention provides a simple and reliable switch which may be remotely controlled through a low voltage circuit. There is little friction involved in the movement of T-bar 24 and long life will therefore result. The components of the switch 10 are less expensive than the components of other remote-control switches known in the prior art. The solenoid is utilized only to momentarily raise the T-bar and therefore is activated only a fraction of the time, reducing the potential for the solenoid to overheat or otherwise wear out. Also as mentioned, any number of pushbutton or similar switches may be connected in parallel to the low voltage system operating solenoid 15 of the present invention to provide a variety of remote locations at which the connected electrical component, such as light 17, may be controlled.

While there have been described above the principles of this invention in connection with specific apparatus, it is to be clearly understood that this description is made only by way of example and not as a limitation in the scope of the invention.

What is claimed is:

1. An electrical switch which comprises:

a support;

a member rotatably mounted upon said support;

contacts mounted to said support and connectable to an electrical circuit;

contact arms electrically connected together and attached to said member, said member having a first position in which said arms are spaced apart from said contacts and a second position in which said member has been rotated from the first position and in which said arms touch said contacts; and rotating means for successively rotating said member between the first and second positions, said rotating means including a T-bar slidably mounted to said support, said T-bar having a base and a cross member and being slidable along its base, the cross member having first and second ends, said member having first and second surfaces positioned to be engaged by the first and second ends, respectively, of the cross member when said T-bar is slid along its base;

said rotating means further including slide means for successively sliding said T-bar along its base in a first direction and then in a directly opposite second direction, the sliding of said T-bar in the first direction causing the cross member to be displaced from said member, the sliding of said T-bar in the second direction causing one end of the cross member to engage the respective surface of said member to rotate said member to one of its positions, successive sliding of said T-bar in the first direction and in the second direction causing the other end of the cross member to engage the respective surface of said member to rotate said member to the other of its positions.

2. The switch of claim 1 in which the base of said T-bar comprises a flexible and resilient material, the base being straight when said T-bar is slid in the first direction and the cross member is displaced from said member, the base extending parallel to said support and defining a longitudinal axis, the rotational axis of said member lying within a plane normal to said support and passing through the longitudinal axis of the base, the first end of the cross member being located a greater perpendicular distance from said plane than the first surface of said member when said member is in the first position, the second end of the cross member being located a greater perpendicular distance from said plane than the second surface of said member when said member is in the second position;

said rotating means further including holding means for holding the first end to the first surface as said member is rotated from the first position to the second position and further for holding the second end to the second surface when said member is rotated from the second position to the first position.

3. The switch of claim 2 in which said holding means comprises the cross member including first and second end portions adjacent to the first and second ends, respectively, the end portions being angled toward the base of said T-bar and positioned to engage and hold the ends to the respective surfaces of said member as said T-bar is slid in the second direction.

4. The switch of claim 2 in which said slide means includes an arm connected to said support, said arm defining an opening within which the base of said T-bar is slidingly received.

5. The switch of claim 2 in which said slide means includes a spring connected at one end to said support and connected at the other end to said T-bar, the spring urging said T-bar in the second direction.

6. The switch of claim 5 in which said slide means further includes the base of said T-bar having an exposed portion which may be manually operated to move said T-bar in the first direction.

7. The switch of claim 5 in which said slide means further includes a hollow core solenoid, the base of said T-bar being received in the core of said solenoid, said solenoid being operable to displace said T-bar in the first direction.

8. The switch of claim 7 in which said slide means further includes a transformer having high voltage and low voltage connections, the high voltage connections of the transformer being connectable to an electrical power source, the solenoid being connected to the low voltage connections of the transformer.

9. The switch of claim 7 in which the solenoid includes a pushbutton switch, the pushbutton switch being operable to momentarily activate the solenoid to move said T-bar in the first direction, the spring thereafter urging said T-bar in the second direction, whereby repeated engagement of the pushbutton switch causes successive movements of the T-bar in the first and second directions.

10. A method for controlling the activation of an electrical system which comprises the steps of:

a. moving a T-bar in a first direction, the T-bar including a base and a cross member having first and second ends, the first direction being parallel to the base and in the direction of the cross member, b. after step *a*, moving the T-bar in a second direction directly opposite to the first direction to cause the first end of the cross member to engage one side of a rotating member, the member being rotatably mounted upon a support, the rotating of the member causing contact arms carried by the member to touch contacts mounted upon the support;

c. after step *b*, moving the T-bar in the first direction to displace the cross member from the rotating member; and d. after step *c*, moving the T-bar in the second direction to cause the second end of the cross member to engage a second side of the rotating member, the rotating of the member causing the contact arms carried by the rotating member to be moved out of touch with the contacts mounted upon the support.

11. The method of claim 10 in which steps *a* and *c* are performed by activating a solenoid which moves the T-bar in the first direction.

12. The method of claim 10 in which steps *b* and *d* are performed by a spring which is connected between the T-bar and the support and urges the T-bar in the second direction.

13. The method of claim 11 in which steps *b* and *d* are performed by a spring which is connected between the T-bar and the support and urges the T-bar in the second direction.

* * * * *